US010882718B2

(12) United States Patent
Funai

(10) Patent No.: US 10,882,718 B2
(45) Date of Patent: Jan. 5, 2021

(54) GUIDE RAIL FIXING DEVICE

(71) Applicant: Mitsubishi Electric Corporation, Chiyoda-ku (JP)

(72) Inventor: Nobuhito Funai, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 435 days.

(21) Appl. No.: 15/754,041

(22) PCT Filed: Sep. 11, 2015

(86) PCT No.: PCT/JP2015/075781
§ 371 (c)(1),
(2) Date: Feb. 21, 2018

(87) PCT Pub. No.: WO2017/042945
PCT Pub. Date: Mar. 16, 2017

(65) Prior Publication Data

US 2018/0251341 A1 Sep. 6, 2018

(51) Int. Cl.
*B66B 7/02* (2006.01)
*B66B 11/02* (2006.01)

(52) U.S. Cl.
CPC ..... *B66B 7/024* (2013.01); *B66B 7/02* (2013.01); *B66B 7/022* (2013.01); *B66B 11/0273* (2013.01)

(58) Field of Classification Search
CPC ..... B66B 7/024; B66B 7/02; B66B 7/022; B66B 11/0273
See application file for complete search history.

(56) References Cited

U.S. PATENT DOCUMENTS 4,577,729 A * 3/1986 Karol ..... B66B 7/024 187/408
6,305,615 B1 * 10/2001 Traktovenko ..... B66B 7/02 187/408

(Continued)

FOREIGN PATENT DOCUMENTS

JP 58-038670 U 9/1956
JP 55-020708 Y2 5/1980

(Continued)

OTHER PUBLICATIONS

International Search Report dated Dec. 15. 2015, in PCT/JP2015/075781 flied Sep. 11, 2015.

(Continued)

*Primary Examiner* — Michael A Riegelman
(74) *Attorney, Agent, or Firm* — Xsensus LLP

(57) ABSTRACT

A guide rail fixing device that can increase frictional force against a guide rail without increasing the number of brackets installed on an inner wall of a hoistway. The guide rail fixing device includes: a rail bracket in contact with a bottom face of a base of a guide rail placed in the lowest portion out of multiple guide rails arranged in line in an elevator hoistway; a rail clip to clamp the base of the guide rail in cooperation with the rail bracket; and a friction plate which is in contact both with the bottom face of the base of the guide rail placed in the lowest portion and in contact with an upper end of the rail bracket, to clamp, in cooperation with a rail clip, the base of the guide rail placed in the lowest portion.

10 Claims, 9 Drawing Sheets

(56) References Cited

U.S. PATENT DOCUMENTS

| | | | | |
|---|---|---|---|---|
| 6,371,249 | B1 * | 4/2002 | Schops | B66B 7/024 187/408 |
| 2004/0216963 | A1 * | 11/2004 | Kurzo | B66B 7/024 187/408 |
| 2018/0251341 | A1 * | 9/2018 | Funai | B66B 7/02 |
| 2018/0297815 | A1 * | 10/2018 | Kirsch | B66B 7/024 |
| 2018/0354750 | A1 * | 12/2018 | Fonteneau | B66B 7/02 |
| 2018/0362299 | A1 * | 12/2018 | Polinski | B66B 7/021 |
| 2018/0370766 | A1 * | 12/2018 | Madureira De Almeida | B66B 7/024 |
| 2019/0023533 | A1 * | 1/2019 | Kalynytschenko | B66B 7/02 |
| 2019/0367327 | A1 * | 12/2019 | Kallio | B66B 7/026 |
| 2020/0031622 | A1 * | 1/2020 | Ferri | B66B 7/024 |
| 2020/0115190 | A1 * | 4/2020 | Xiong | B66B 7/024 |

FOREIGN PATENT DOCUMENTS

| | | | |
|---|---|---|---|
| JP | 3-072578 | U | 7/1991 |
| JP | 6-239559 | A | 8/1994 |
| JP | 6-255941 | A | 9/1994 |
| JP | 2000-118909 | A | 4/2000 |
| JP | 2001-171941 | A | 6/2001 |
| JP | 2002-338168 | A | 11/2002 |
| JP | 2003-335478 | A | 11/2003 |
| JP | 3961916 | B2 | 5/2007 |
| JP | 5098368 | B2 | 10/2012 |
| JP | 5350062 | B2 | 8/2013 |
| JP | 5646064 | B2 | 11/2014 |

OTHER PUBLICATIONS

Notification of Reason for Resusal issued in Korean Application 10-2018-7008475 dated Apr. 23, 2019.

* cited by examiner

GUIDE RAIL FIXING DEVICE

TECHNICAL FIELD

The present invention relates to a guide rail fixing device for an elevator.

BACKGROUND ART

In an elevator hoistway, a pair of guide rails for guiding each of an elevator car and a counter weight to ascend and descend are installed over the entire ascending/descending range of the elevator car and the counter weight. Each guide rail is fixed to a beam or a wall-side bracket installed on a hoistway inner-wall with guide rail fixing devices each of which consists of a rail clip, a rail bracket, a bolt, a nut, and a spring washer (for example, Patent Document 1 and Patent Document 2).

Also, the guide rail installed in a high-rise building may be bent or bucked to deform, when there occurs heat shrinkage of steel frames of the building, concrete contraction due to its creep phenomena, or, interlayer displacement or uneven settlement caused by weight increase due to installation of air conditioners or the like. To deal with this problem, a guide rail fixing device is known (for example, Patent Document 3), with which the guide rail is fixed so that a space is provided between the lowest end of the guide rail and the bottom of the hoistway, to prevent the guide rail from deforming.

PRIOR ART DOCUMENT

Patent Document

Patent Document 1: Japanese Patent Laid-Open Publication No. H6-239559 (Page 2, FIG. 1)

Patent Document 2: Japanese Patent Laid-Open Publication No. H6-255941 (Page 5, FIG. 2)

Patent Document 3: Japanese Utility Model Laid-Open Publication No. H3-72578 (Page 6, FIG. 5)

SUMMARY OF THE INVENTION

Problem to be Solved by the Invention

In a case where a conventional guide rail fixing device includes design errors in a guide rail or a rail clip, enough frictional force is sometimes not produced between the guide rail and the guide rail fixing device. In this case, when the building provided with an elevator is widely swung by an earthquake or a strong wind, the guide rail may fall.

If more guide rail fixing devices are installed to increase the number of spots for fixing the guide rails, the frictional force between the guide rail and the guide rail fixing devices can be increased. Considering, however, the fact that the guide rail fixing devices are fixed to beams or wall-side brackets installed on a hoistway inner-wall, the increased number of spots for fixing the guide rails raises the number of the beams or wall-side brackets to be installed on the hoistway inner-wall, resulting in a building installation cost.

The present invention is made to solve the problems described above and to provide a guide rail fixing device which can increase the frictional force against the guide rail without increasing the number of the beams or wall-side brackets to be installed on the hoistway inner-wall.

Means for Solving Problem

A guide rail fixing device according to the present invention includes: a rail bracket in contact with a bottom face of a base of a guide rail placed in a lowest portion out of guide rails arranged in line in an elevator hoistway; a first rail clip to clamp the base of the guide rail in cooperation with the rail bracket; and a friction plate which is in contact with the bottom face of the base of the guide rail placed in the lowest portion and in contact with an upper end of the rail bracket, the friction plate to clamp, in cooperation with a second rail clip, the base of the guide rail placed in the lowest portion.

Effects of the Invention

According to the present invention, the frictional force between the guide rail and the guide rail fixing device can be increased without increasing the number of the beams or wall-aide brackets to be installed on the hoistway inner-wall.

EMBODIMENT FOR CARRYING OUT THE INVENTION

Embodiment 1

Figure 1:
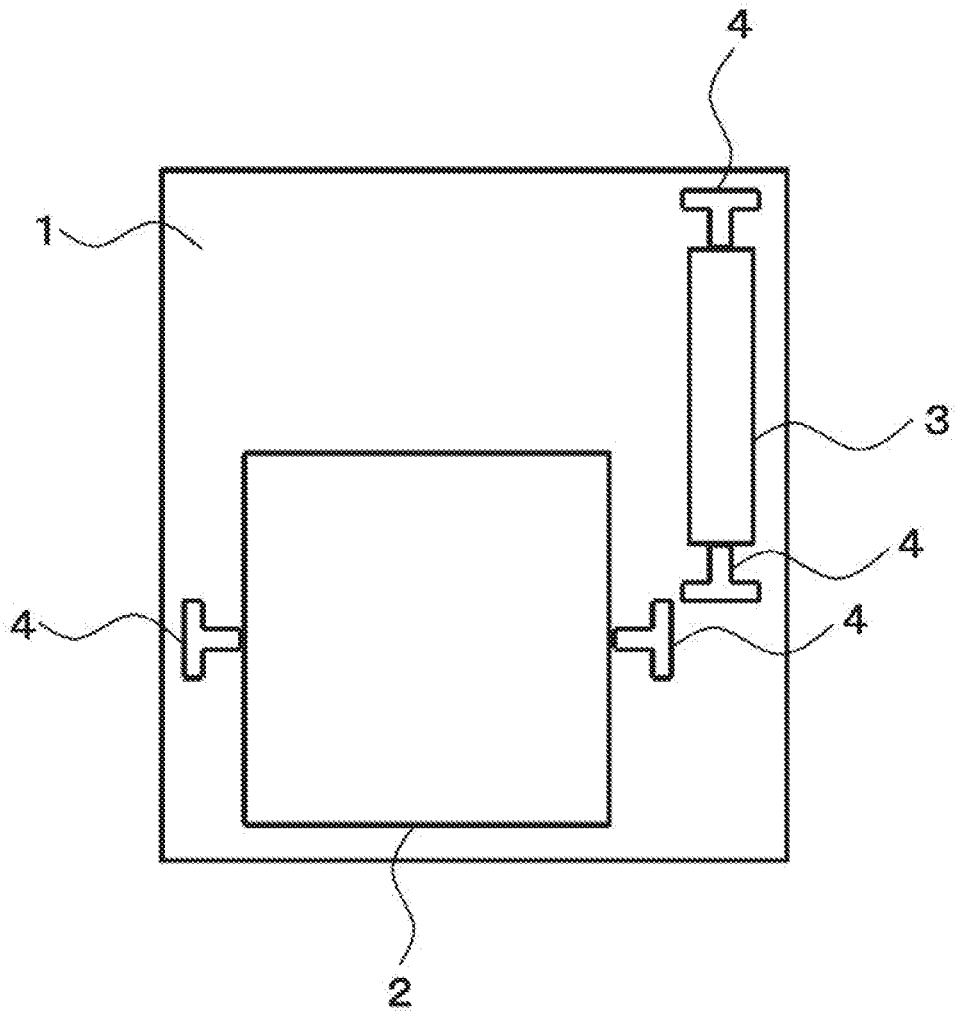
FIG. 1 is a cross-sectional plan view of an elevator hoistway.

FIG. 1 is a cross-sectional plan view of an elevator hoistway 1. In the hoistway 1, an elevator car 2 and a counter weight 3 are suspended with a rope (not illustrated). Guide rails 4 are made in pairs to sandwich each of the elevator car 2 and the counter weight 3, and are installed over the entire ascending/descending range of the elevator car 2 and the counter weight 3. In addition, the guide rails 4 are each configured by arranging and fixing plural guide rails 4 in line over the entire ascending/descending range of the elevator car 2 and the counter weight 3.

Figure 2:
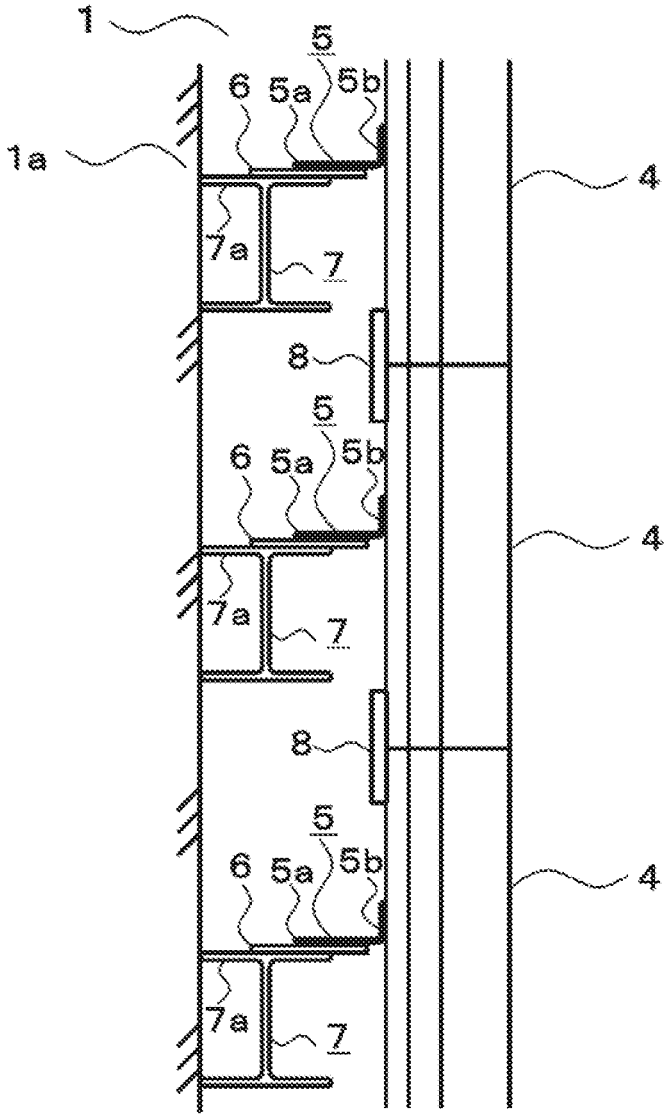
FIG. 2 is a diagram for explaining a guide rail mounting method according to a beam mounting method.

FIG. 2 is a diagram for explaining a method for mounting the guide rails 4 according to a beam mounting method. In the beam mounting method, each of the guide rails 4 is fixed, via a rail bracket 5 and a base plate 6, to a beam 7. The rail bracket 5 is a steel member which consists of a horizontal part 5*a* and a vertical part 5*b* extending continuously and vertically upward from the horizontal part 5*a* to have an L-shaped cross-section. The vertical part 5*b* is in contact with the guide rail 4. The base plate 6 is a plate member which is welded and fixed to the lower face of the horizontal part 5*a* of the rail bracket 5. Plural beams 7, for example H-section steel, are installed vertically and separately from each other on an inner wall 1*a* of the hoistway 1 so that flanges 7*a* of the H-section steels are horizontal. The upper face of the flange 7*a* positioned on the upper side of every beam 7 is welded and fixed to the lower face of the corresponding base plate 6.

Fishplates 8 are provided between the guide rails 4 to suppress vibration caused when the elevator car 2 or the counter weight 3 ascends or descends to pass through the level difference between the guide rails 4.

Figure 3:
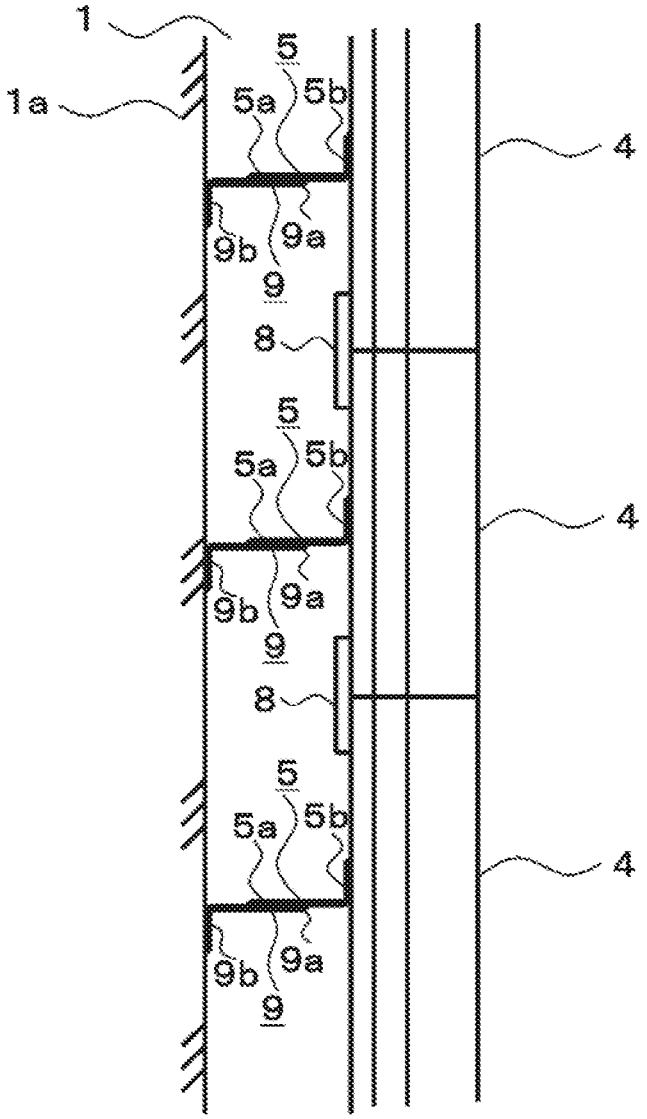
FIG. 3 is a diagram for explaining a guide rail mounting method according to a wall mounting method.

FIG. 3 is a diagram for explaining a method for mounting the guide rails 4 according to a wall mounting method. In the wall mounting method, each of the guide rails 4 is fixed, via the rail bracket 5 and a wall-side bracket 9, to the inner wall 1*a* of the hoistway 1. The rail bracket 5 used here is the same as the rail bracket 5 used in the beam mounting method and the vertical part 5*b* is in contact with the guide rail 4. The wall-side bracket 9 is a steel member which consists of a horizontal part 9*a* and a vertical part 9*b* extending continuously and vertically downward from the horizontal part 9*a* to have an L-shaped cross-section. The horizontal part 9*a* is welded and fixed to a lower face of the horizontal part 5*a* of the rail bracket 5. The vertical part 9*b* is fixed to the inner wall 1*a* of the hoistway 1 with an anchor bolt (not illustrated).

Also in the wall mounting method, similarly to the beam mounting method, the fishplates 8 are provided between the guide rails 4 to suppress vibration caused when the elevator car 2 or the counter weight 3 ascends or descends to pass through the level difference between the guide rails 4.

A guide rail fixing device 100 according to this embodiment will be explained by using FIGS. 4 to 9. Hereinafter, explanation will be made about the beam mounting method, and the same explanation is applicable to the wall mounting method.

Figure 4:
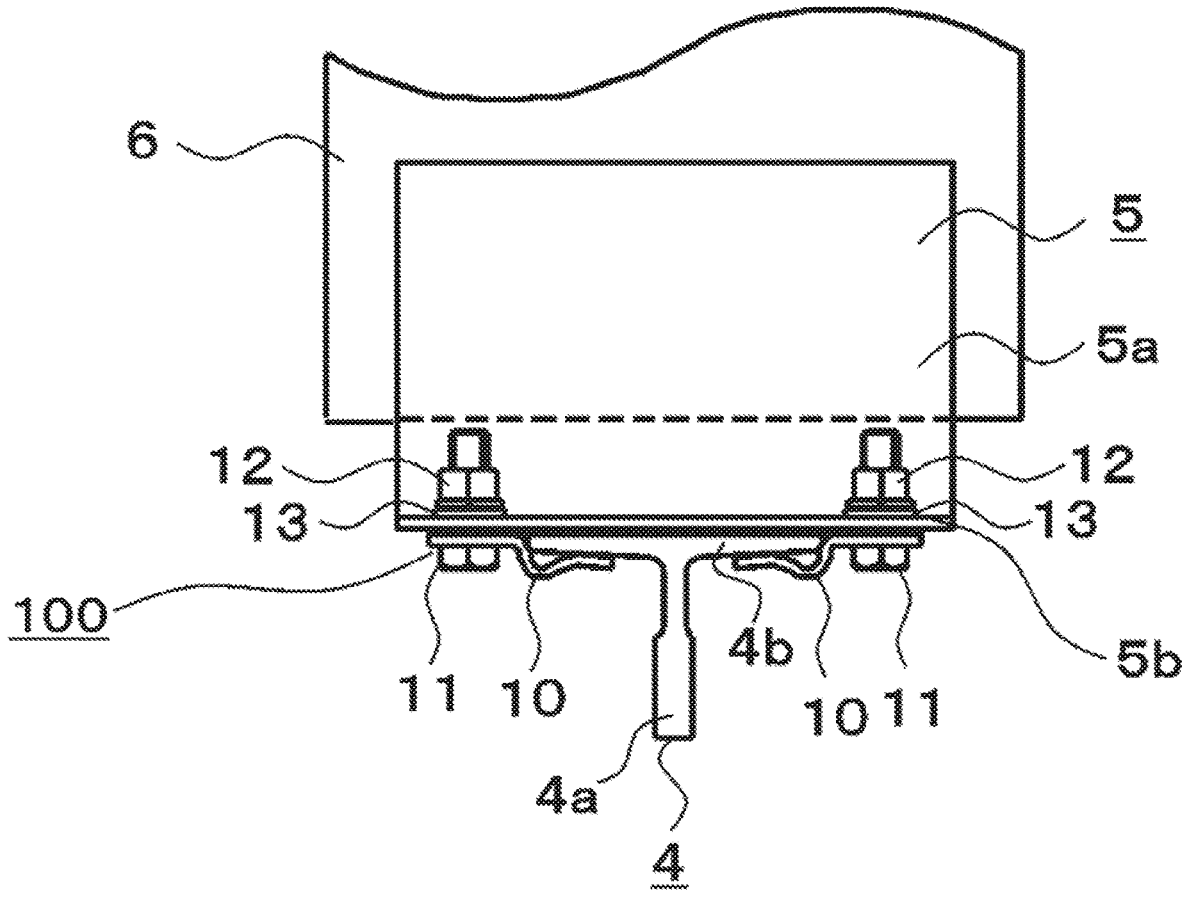
FIG. 4 is a schematic diagram showing a guide rail and a guide rail fixing device to fix the guide rail in a hoistway, according to Embodiment 1 of the present invention.
Figure 5:
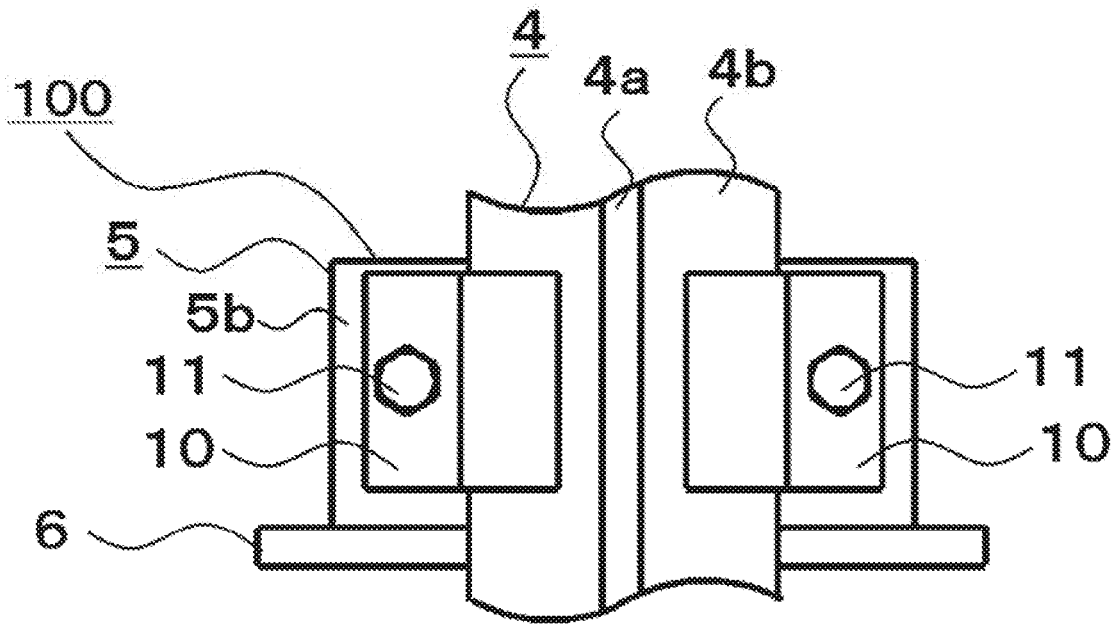
FIG. 5 is a front view of the guide rail fixing device shown in FIG. 4.
Figure 6:
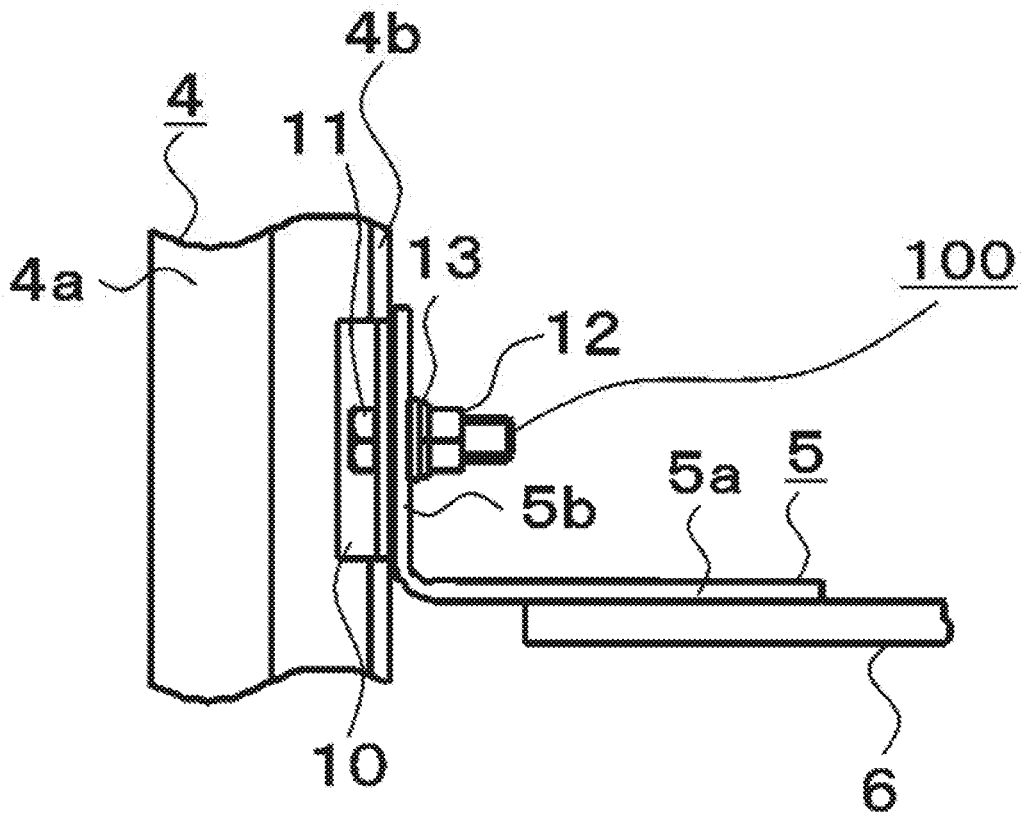
FIG. 6 is a side view of the guide rail fixing device shown in FIG. 4.

FIG. 4 is a schematic diagram of the guide rail 4 and the guide rail fixing device 100 to fix the guide rail 4 in the hoistway 1, according to this embodiment. FIG. 5 is a front view of FIG. 4. FIG. 6 is a side view of FIG. 4.

The guide rail 4 consists of a base 4*a* and a sliding part 4*b* extending vertically from the center of the base 4*a*, and forms a T-shaped cross section. The guide rail 4 is arranged so that the base 4*a* is near the inner wall 1*a* of the hoistway 1 and the sliding part 4*b* is near the elevator car 2 or counter weight 3. The guide rail 4 is fixed in the hoistway 1 by using the guide rail fixing device 100 having the configuration below.

As shown in FIGS. 4 to 6, the guide rail fixing device 100 includes the rail bracket 5, rail clips 10, bolts 11, nuts 12, and spring washers 13. The vertical part 5*b* of the rail bracket 5 is in contact with the bottom face of the base 4*a* of the guide rail 4 which faces the inner wall 1*a* of the hoistway 1. The rail clips 10 are in contact with two width-direction ends of the base 4*a* of the guide rail 4. The bolts 11, the nuts 12, and the spring washers 13 are used when fixing the guide rail 4, for fastening the rail clips 10 to the rail bracket 5 with both the width-direction ends of the base 4*a* kept clamped by the rail clips 10 and the rail bracket 5. The vertical part 5*b* of the rail bracket 5 and the rail clips 10 each have a bolt hole (not illustrated), through which the bolt 11 is inserted to fasten them together.

Figure 7:
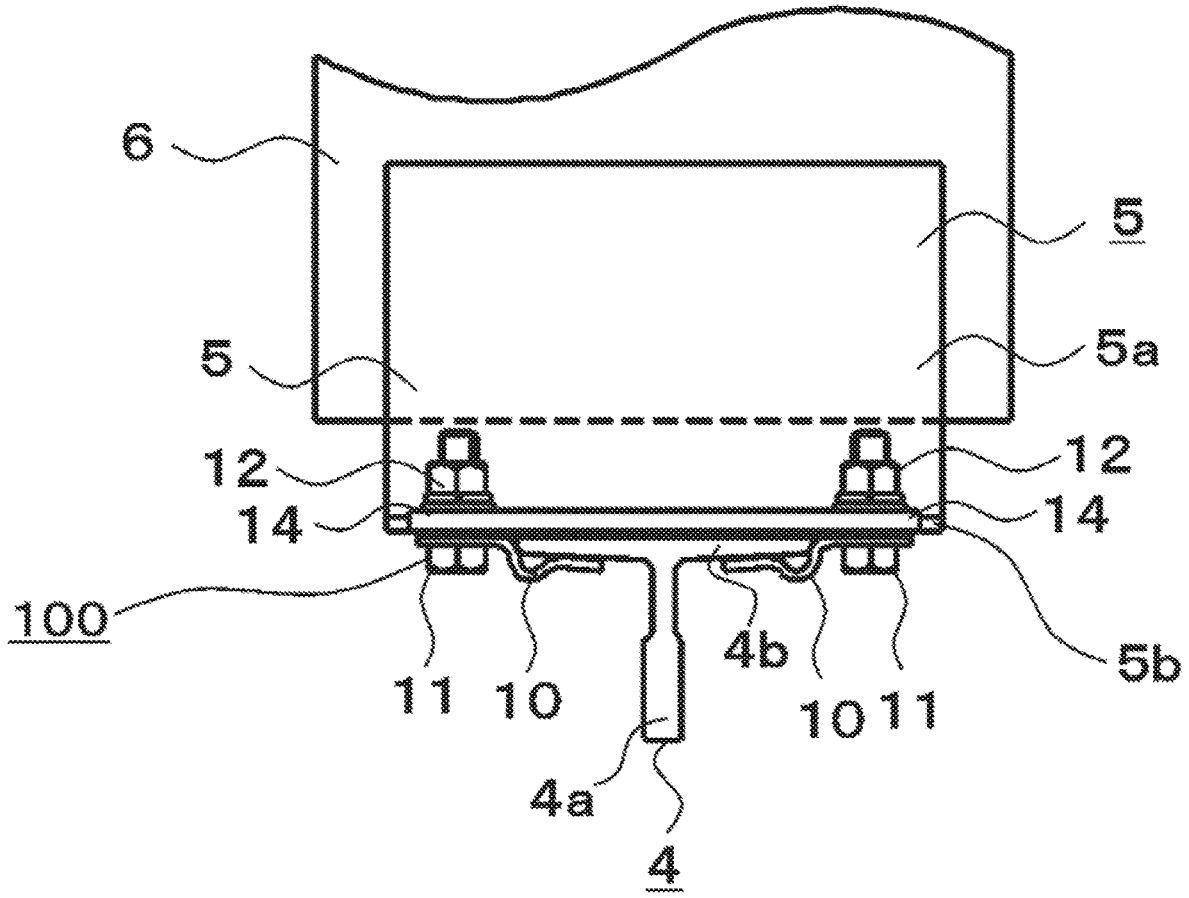
FIG. 7 is a schematic diagram of the guide rail fixing device according to Embodiment 1 which is arranged in the lowest portion to fix the guide rail.
Figure 8:
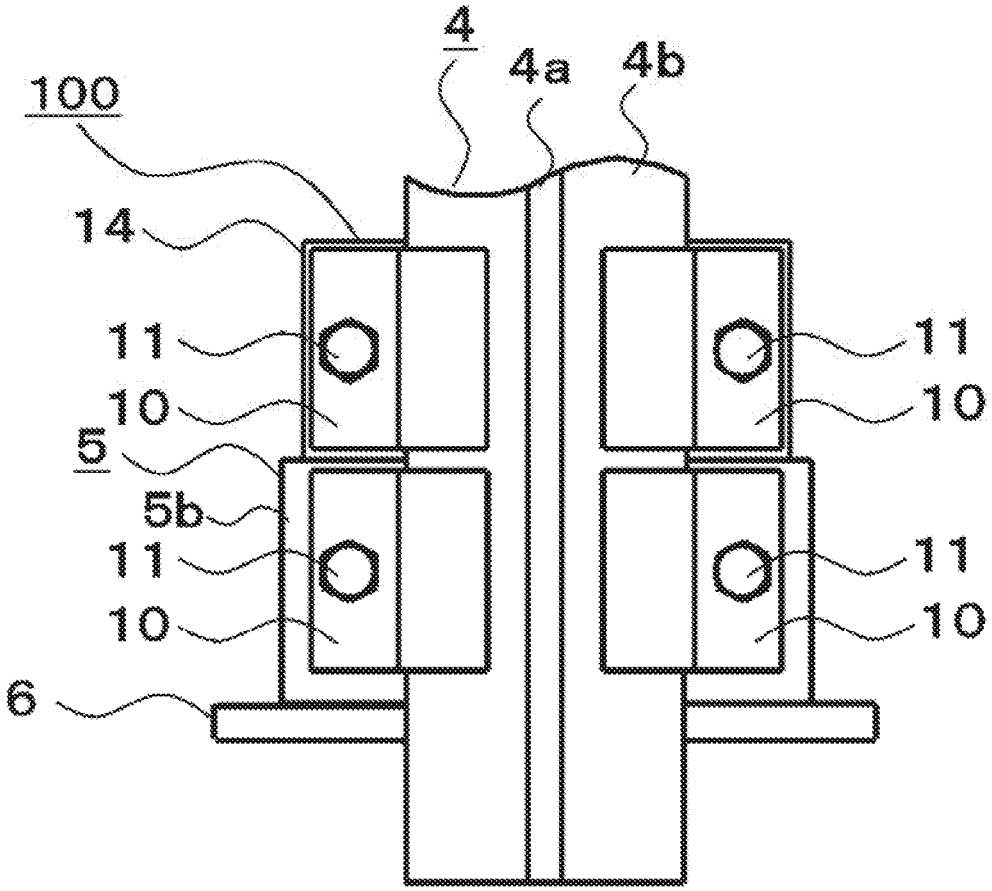
FIG. 8 is a front view of the guide rail fixing device shown in FIG. 7.
Figure 9:
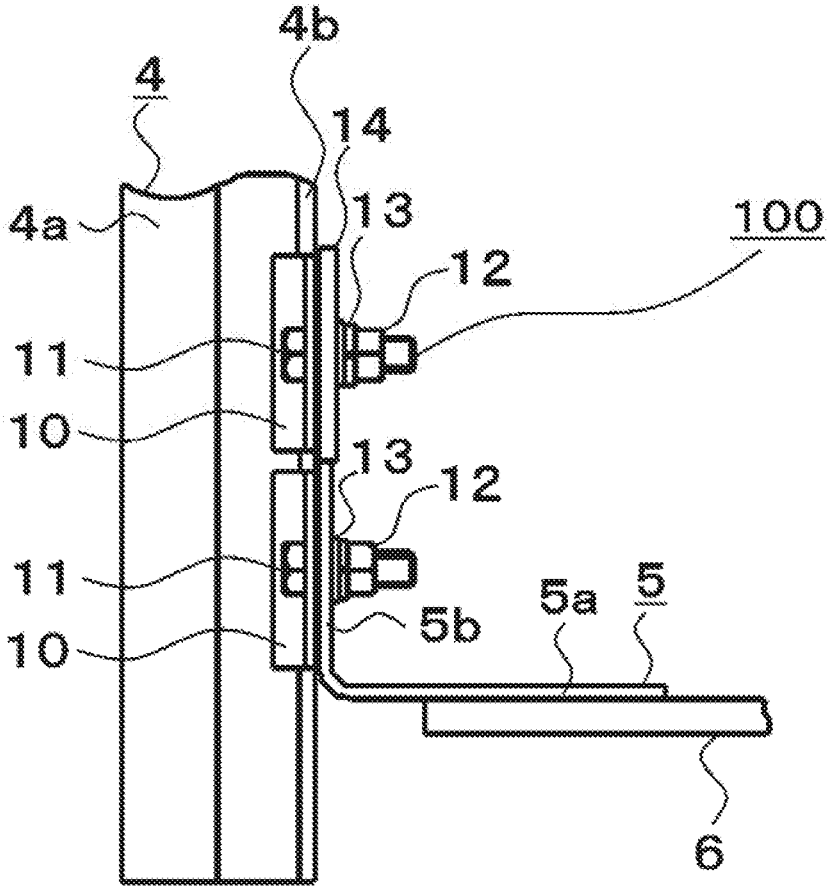
FIG. 9 is a side view of the guide rail fixing device shown in FIG. 7.

FIG. 7 is a schematic diagram of a guide rail fixing device 100 to fix the guide rail 4 placed in the lowest portion according to this embodiment. FIG. 8 is a front view of FIG. 7. FIG. 9 is a side view of FIG. 7.

As shown in FIGS. 7 to 9, the guide rail fixing device 100 includes a rail bracket 5, rail clips 10, bolts 11, nuts 12, spring washers 13, and a friction plate 14. The friction plate 14 has a rectangular shape, whose long side is longer than the width of the base 4*a* of the guide rail 4. The friction plate 14 is in contact with the bottom face of the base 4*a* of the guide rail 4 which faces the inner wall 1*a* of the hoistway 1. The lower end of the friction plate 14 is in contact with the upper end of the vertical part 5*b* of the rail bracket 5. In a state in which width-direction ends of the base 4*a* of the guide rail 4 are clamped by the rail clips 10 and the friction plate 14, the friction plate 14 is fastened to the rail clips 10 with the bolts 11, nuts 12, and spring washers 13. The friction plate 14 and the rail clip 10 each have a bolt hole (not illustrated), through which the bolt 11 is inserted to fasten them together. The rail clips 10 which clamp, in cooperation with the friction plate 14, the base 4*a* of the guide rail 4 are the same components as the rail clips 10 which clamp the base 4*a* in cooperation with the rail brackets 5. Also, the bolts 11, nuts 12, and spring washers 13 used for fastening the rail clips 10 to the friction plate 14 are respectively the same as the bolts 11, nuts 12, and spring washers 13 used for fastening the rail clips 10 to the rail bracket 5.

When perpendicularly downward force acts to the guide rail 4 fixed by the guide rail fixing device 100 according to this embodiment, the guide rail 4 is held by frictional force between the guide rail 4 and the friction plate 14 which is placed at a positon higher than the rail bracket 5 and is in contact with the upper end of the vertical part 5*b*. Therefore, the guide rail 4 can be prevented from falling.

It is preferable that the friction plate 14 is formed of a plate member with a friction coefficient higher than that of the rail bracket. If the material of the friction plate 14 is the same as that of the rail bracket 5, it is preferable that roughness is produced on a face of the friction plate in contact with the base 4*a* of the guide rail 4 to increase the vertical friction coefficient. This can increase the frictional force between the guide rail 4 and the guide rail fixing device 100.

It should be noted that instead of being provided only to the guide rail fixing device 100 fixing the lowermost guide rail 4, the friction plate 14 may be provided to every guide rail fixing device 100, or may be provided to any number of the guide rail fixing devices 100. By adjusting the number of the friction plates 14 to be provided, the frictional force between the guide rails 4 and the guide rail fixing devices 100 can be adjusted.

As described above, in the guide rail fixing device 100 according to this embodiment, the friction plate 14 is provided at a positon higher than that of the rail bracket 5 fixing the lowermost guide rail 4 so that the friction plate 14 is in contact with the upper end of the vertical part 5*b*, to increase the frictional force against the guide rail 4. This can prevent the guide rail 4 from falling without increasing the number of the rail brackets 5 installed.

Furthermore, in the fixing device 100 according to this embodiment, the friction coefficient of the face of the friction plate 14 in contact with the bottom face of the base 4*a* of the guide rail 4 is larger than that of the face of the rail bracket 5 in contact with the same bottom face, which thereby can prevent the guide rail 4 from falling without increasing the number of the rail brackets 5.

Moreover, because the guide rail fixing device 100 according to this embodiment can increase the frictional force against the guide rail 4 without increasing the number of installed rail brackets 5, it becomes unnecessary to increase the number of the beams 7 or the wall-side brackets 9 to be fixed on the inner wall 1*a* of the hoistway 1, so that the guide rail 4 can be prevented from falling without increasing the installation cost.

Moreover, the guide rail fixing device 100 according to this embodiment uses the same parts as the rail clip 10, the bolt 11, the nut 12, and the spring washer 13 which are used for fixing the guide rail 4 in the hoistway 1, to increase the frictional force against the guide rail 4. This can prevent the manufacturing cost and installation cost from increasing due to the number of the parts' types which might be increased.

Moreover, the guide rail fixing device 100 according to this embodiment includes the rail bracket 5 which is in contact with the bottom face of the base 4*a* of the guide rail 4 placed in the lowest portion out of multiple guide rails 4 arranged in line in the elevator hoistway 1, and the rail clips 10 which clamp the base 4*a* of the guide rail 4 in cooperation with the rail brackets 5. Moreover, the guide rail fixing device 100 includes the friction plate 14 which is in contact with the bottom face of the base 4*a* of the guide rail 4 placed in the lowest portion and in contact with the upper end of the rail bracket 5 to clamp, in cooperation with the rail clips 10, the base 4*a* of the guide rail 4 placed in the lowest portion. With such a configuration, the guide rail fixing device 100 according to this embodiment can have an increased frictional force against the guide rail 4 without increasing the number of the beams 7 or the wall-side brackets 9 fixed to the inner wall 1*a* of the hoistway 1.

In addition, in the guide rail fixing device 100 according to this embodiment, the friction coefficient of the face of the friction plate 14 in contact with the bottom face of the base 4*a* of the guide rail 4 is larger than the friction coefficient of the face of the rail bracket 5 in contact with the bottom face of the base 4*a* of the guide rail 4. Therefore, the guide rail fixing device 100 can have a further increased frictional force against the guide rail 4.

Furthermore, in the guide rail fixing devices 100 according to this embodiment, the rail clip 10 to clamp, in cooperation with the friction plate 14, the base 4*a* of the guide rail 4 placed in the lowest portion is the same type as the rail clip 10 to clamp, in cooperation with the rail bracket 5, the base 4*a* of the guide rail 4. This can prevent the number of part types of the guide rail fixing device 100 from increasing, thereby preventing manufacturing cost and installation cost from increasing.

Furthermore, in the guide rail fixing devices 100 according to this embodiment, the rail brackets 5 are in contact with the respective bottom faces of the bases 4*a* of the multiple guide rails 4. Moreover, the rail clips 10 clamp the respective bases 4*a* of the multiple guide rails 4 in cooperation with the rail brackets 5. Moreover, a friction plate 14 is additionally provided to a guide rail 4 other than the guide rail 4 placed in the lowest portion, wherein the friction plate 14 is in contact with the bottom face of the base 4*a* of the guide rail 4 and is in contact with the upper end of the rail bracket 5 in contact with the bottom face of the base 4*a* of the guide rail 4, to clamp the base 4*a* of the guide rail 4 in cooperation with the rail clips 10. In this configuration of the guide rail fixing devices 100, the total amount of frictional force against the guide rails 4 can be adjusted by changing the number of the friction plates 14 to be installed.

It should be noted that the friction plate 14 according to this embodiment can be installed to the existing guide rails 4. Therefore, in a case where the frictional force between the guide rail 4 and the guide rail fixing device 100 is reduced due to lapse of time for example, the frictional force can be increased by providing the required number of the friction plates 14, whereby it becomes unnecessary to replace parts of the guide rail fixing device 100.

DESCRIPTION OF SYMBOLS

1: hoistway
1*a*: inner wall
2: elevator car
3: counter weight
4: guide rail
4*a*: base
4*b*: sliding part
5: rail bracket
6: base plate
7: beam
7*a*: flange
8: fishplate
9: wall-side bracket
10: rail clip
11: bolt
12: nut
13: spring washer
14: friction plate
100: guide rail fixing device

The invention claimed is:

1. A guide rail fixing device comprising:

a rail bracket in contact with a bottom face of a base of a guide rail placed in a lowest portion out of guide rails arranged in line in an elevator hoistway;

a first rail clip to clamp the base of the guide rail in cooperation with the rail bracket; and a friction plate which is in direct contact with the bottom face of the base of the guide rail placed in the lowest portion and in direct contact with an upper end of the rail bracket, the friction plate to clamp, in cooperation with a second rail clip, the base of the guide rail placed in the lowest portion.

2. The guide rail fixing device according to claim 1, wherein a friction coefficient of a face of the friction plate in contact with the bottom face of the base of the guide rail is larger than that of a face of the rail bracket in contact with the bottom face of the base of the guide rail.

3. The guide rail fixing device according to claim 2, wherein the second rail clip to clamp, in cooperation with the friction plate, the base of the guide rail placed in the lowest portion is same type as the first rail clip to clamp, in cooperation with the rail bracket, the base of the guide rail.

4. The guide rail fixing device according to claim 3, wherein the rail bracket comprises multiple rail brackets each of which is in contact with a bottom face of a base of a corresponding guide rail out of the multiple guide rails; the first rail clip comprises multiple first rail clips each of which clamps, in cooperation with a corresponding rail bracket of the multiple rail brackets, the base of the corresponding guide rail out of the multiple guide rails; and at least one friction plate is additionally provided to a guide rail other than the guide rail placed in the lowest portion, the at least one friction plate being in contact with a bottom face of a base of the guide rail and being in contact with an upper end of a rail bracket in contact with the bottom face of the base of the guide rail, the at least one friction plate clamping, in cooperation with another second rail clip, the base of the guide rail.

5. The guide rail fixing device according to claim 2, wherein the rail bracket comprises multiple rail brackets each of which is in contact with a bottom face of a base of a corresponding guide rail out of the multiple guide rails; the first rail clip comprises multiple first rail clips each of which clamps, in cooperation with a corresponding rail bracket of the multiple rail brackets, the base of the corresponding guide rail out of the multiple guide rails; and at least one friction plate is additionally provided to a guide rail other than the guide rail placed in the lowest portion, the at least one friction plate being in contact with a bottom face of a base of the guide rail and being in contact with an upper end of a rail bracket in contact with the bottom face of the base of the guide rail, the at least one friction plate clamping, in cooperation with another second rail clip, the base of the guide rail.

6. The guide rail fixing device according to claim 1, wherein the second rail clip to clamp, in cooperation with the friction plate, the base of the guide rail placed in the lowest portion is same type as the first rail clip to clamp, in cooperation with the rail bracket, the base of the guide rail.

7. The guide rail fixing device according to claim 6, wherein the rail bracket comprises multiple rail brackets each of which is in contact with a bottom face of a base of a corresponding guide rail out of the multiple guide rails; the first rail clip comprises multiple first rail clips each of which clamps, in cooperation with a corresponding rail bracket of the multiple rail brackets, the base of the corresponding guide rail out of the multiple guide rails; and at least one friction plate is additionally provided to a guide rail other than the guide rail placed in the lowest portion, the at least one friction plate being in contact with a bottom face of a base of the guide rail and being in contact with an upper end of a rail bracket in contact with the bottom face of the base of the guide rail, the at least one friction plate clamping, in cooperation with another second rail clip, the base of the guide rail.

8. The guide rail fixing device according to claim 1, wherein the rail bracket comprises multiple rail brackets each of which is in contact with a bottom face of a base of a corresponding guide rail out of the multiple guide rails; the first rail clip comprises multiple first rail clips each of which clamps, in cooperation with a corresponding rail bracket of the multiple rail brackets, the base of the corresponding guide rail out of the multiple guide rails; and at least one friction plate is additionally provided to a guide rail other than the guide rail placed in the lowest portion, the at least one friction plate being in contact with a bottom face of a base of the guide rail and being in contact with an upper end of a rail bracket in contact with the bottom face of the base of the guide rail, the at least one friction plate clamping, in cooperation with another second rail clip, the base of the guide rail.

9. The guide rail fixing device according to claim 1, wherein a longest dimension of the friction plate is larger than a width of the base of the guide rail.

10. The guide rail fixing device according to claim 1, wherein the second rail clip is arranged opposite to the first rail clip in a width direction of the guide rail.

* * * * *